US008726689B2

(12) United States Patent
Jang et al.

(10) Patent No.: US 8,726,689 B2
(45) Date of Patent: May 20, 2014

(54) REFRIGERATOR WITH COLD STORAGE UNIT

(75) Inventors: Young Shin Jang, Gwangju (KR); Young Gwi Park, Gwangju (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 904 days.

(21) Appl. No.: 12/314,448

(22) Filed: Dec. 10, 2008

(65) Prior Publication Data

US 2009/0277209 A1 Nov. 12, 2009

(30) Foreign Application Priority Data

May 6, 2008 (KR) ..... 20-2008-0005924 U
Aug. 4, 2008 (KR) ..... 10-2008-0076039

(51) Int. Cl.

| | |
|---|---|
| ***F25D 11/02*** | (2006.01) |
| ***F25D 13/00*** | (2006.01) |
| ***F25D 17/04*** | (2006.01) |
| ***F25D 17/06*** | (2006.01) |

(52) U.S. Cl.
USPC ..... 62/441; 62/443; 62/444; 62/458; 62/404; 62/429

(58) Field of Classification Search
USPC ..... 62/441, 443, 444, 448–449, 458, 465, 62/404, 429
See application file for complete search history.

(56) References Cited

U.S. PATENT DOCUMENTS

| | | | | | |
|---|---|---|---|---|---|
| 2,773,677 | A | * | 12/1956 | Hinkel | 165/263 |
| 3,218,111 | A | * | 11/1965 | Steiner | 312/405.1 |
| 4,186,978 | A | * | 2/1980 | Thomson | 312/321.5 |
| 5,209,082 | A | * | 5/1993 | Ha | 62/265 |
| 5,723,002 | A | * | 3/1998 | Delk et al. | 607/114 |
| 5,975,334 | A | * | 11/1999 | Mayo | 220/592.03 |
| 6,083,254 | A | * | 7/2000 | Evans | 607/96 |
| 6,601,415 | B2 | * | 8/2003 | Takinami | 70/57.1 |
| 2005/0144970 | A1 | * | 7/2005 | Cho et al. | 62/441 |

FOREIGN PATENT DOCUMENTS

| | | |
|---|---|---|
| DE | 3605891 | 8/1987 |
| EP | 1835246 | 3/2007 |
| JP | 409318242 | * 12/1997 |
| KR | 10-2006-0106412 | 10/2006 |
| KR | 10-2006-0107660 | 10/2006 |
| WO | 2006/035395 | 4/2006 |

OTHER PUBLICATIONS

European Search report dated, Aug. 27, 2009, issued in corresponding Patent Application.

* cited by examiner

*Primary Examiner* — Khoa Huynh
*Assistant Examiner* — Timothy K Trieu
(74) *Attorney, Agent, or Firm* — Staas & Halsey LLP

(57) ABSTRACT

Disclosed is a refrigerator including a storage compartment, a door for opening/closing a front surface of the storage compartment, and a cold storage unit provided in a storage space defined in the storage compartment. The cold storage unit is rotatably installed at one sidewall defining the storage space to serve as a shelf, so that convenience of use and space utility are improved.

16 Claims, 7 Drawing Sheets

REFRIGERATOR WITH COLD STORAGE UNIT

CROSS-REFERENCE TO RELATED APPLICATIONS

This application claims the benefit of Korean Utility Model Application No. 20-2008-0005924 filed on May 6, 2008, in the Korean Intellectual Property Office, and Korean Patent Application No. 10-2008-0076039 filed on Aug. 4, 2008, in the Korean Intellectual Property Office, the disclosures of which are incorporated herein by reference.

BACKGROUND

1. Field

Embodiments of the present invention relates to a refrigerator. More particularly, embodiments of the present invention relate to a refrigerator having a cold storage unit suitable for a multi-purpose use.

2. Description of the Related Art

In general, a refrigerator is an appliance that supplies cold air to a storage compartment storing various foodstuffs so as to allow the foodstuffs to be kept in a fresh state at a low temperature condition. The refrigerator includes a freezing compartment maintained at the temperature below the freezing temperature and a refrigerating compartment maintained at the temperature slightly above the freezing temperature.

Recently, in order to prevent the internal temperature of the storage compartment from excessively rising upon an electricity failure, there has been suggested a refrigerator having a cold storage device in which cold air accumulated during the operation of the refrigerator is supplied into the storage compartment when the refrigerator is not operated due to the electricity failure, thereby properly maintaining the internal temperature of the storage compartment.

SUMMARY

Accordingly, it is an aspect of embodiments of the present invention to provide a refrigerator having a cold storage device, which can prevent the internal temperature of a storage compartment from excessively rising when the refrigerator is not operated due to an electric failure and is suitable for multi-purpose use.

Another aspect of embodiments of the present invention is to provide a refrigerator having a cold storage device, which can improve space utility of a storage compartment even if the cold storage device is installed in the storage compartment.

Still another aspect of embodiments of the present invention is to provide a refrigerator having a cold storage device, which can be easily and stably transported when the refrigerator is used in the field.

Additional aspects and/or advantages will be set forth in part in the description which follows and, in part, will be apparent from the description, or may be learned by practice of the invention.

The foregoing and/or other aspects of embodiments of the present invention are achieved by providing a refrigerator including a storage compartment, a door for opening/closing a front surface of the storage compartment, and a cold storage unit provided in a storage space defined in the storage compartment, wherein the cold storage unit is rotatably installed at one sidewall defining the storage space to serve as a shelf.

A stopper is provided at the sidewall where the cold storage unit is rotatably installed to limit rotation of the cold storage unit when the cold storage unit is perpendicular to the sidewall.

A reinforcement member including metallic material is provided in the stopper.

A recess is formed at the sidewall where the cold storage unit is provided to receive the cold storage unit therein.

A magnet is provided in at least one of the recess and the cold storage unit.

A support member is rotatably coupled to a lower portion of the recess by a hinge, and the support member is formed with an insertion groove to receive the cold storage unit.

The cold storage unit includes a cold storage pack provided at one side thereof with a handle groove section.

The cold storage unit includes an upper frame coupled with a top surface of the cold storage pack and a lower frame coupled with a bottom surface of the cold storage pack, and at least one of the upper and lower frames forms a handle section in cooperation with the cold storage pack.

The upper and lower frames include an elastic coupling section that is elastically deformed to maintain a coupling state between the upper and lower frame.

According to another aspect, there is provided a refrigerator including a storage compartment, a storage compartment door for opening/closing a front surface of the storage compartment, a storage space defined by the storage compartment and the storage compartment door, a recess formed at a sidewall defining the storage space to receive a cold storage unit therein, and a support member rotatably coupled to a lower portion of the recess by at least one hinge such that the cold storage unit is accommodated in the support member.

The recess is formed at an inner wall of the storage compartment door.

The cold storage unit includes a cold storage pack filled with cold storage materials and formed with a handle groove section having a predetermined depth, and upper and lower frames coupled with upper and lower edge portions of the cold storage pack, respectively, to cover an edge portion of the cold storage unit, and at least one of the upper and lower frames forms a handle section in cooperation with the cold storage pack.

The support member includes an insertion groove to receive the cold storage unit therein, hinge shafts provided at both sides of the support member, and a supporter supported by a stopper provided in the storage compartment door to limit a rotational radius of the support member.

The support member is formed with a hinge receptacle to receive at least one of the hinge shafts and the at least one hinge is slidably moved in the hinge receptacle.

According to another aspect of embodiments of the present invention, there is provided a cold storage unit for a refrigerator including a pack with a thermal mass capable of preventing an internal temperature of a storage compartment in the refrigerator from excessively rising, a support member including an insertion groove to receive the pack, and a recess, formed in the side of a refrigerator door, which the pack and support member fit flush within.

The support member may be rotatably installed at a lower end of the recess.

The pack may include a handle groove.

The cold storage unit may further include an upper frame including an upper surface section for supporting an upper edge portion of the pack, lateral sections protruding downward from both side ends of the upper surface section, a front surface section protruding downward from a front end of the upper surface section, and a rear surface section protruding downward from a rear end of the upper surface section.

The cold storage unit may further include a lower frame including a lower surface section having a hollow section with a shape corresponding to a shape of a protrusion plate of the pack such that the protrusion plate, provided at the bottom surface of the pack, can be received in the hollow section when the lower frame supports the pack.

The cold storage unit may further include an upper frame, and a lower frame, wherein the upper frame is closely secured to the lower frame by an elastic coupling member.

BRIEF DESCRIPTION OF THE DRAWINGS

These and/or other aspects and advantages will become apparent and more readily appreciated from the following description of the embodiments, taken in conjunction with the accompanying drawings of which.

DETAILED DESCRIPTION OF EMBODIMENTS

Figure 1:
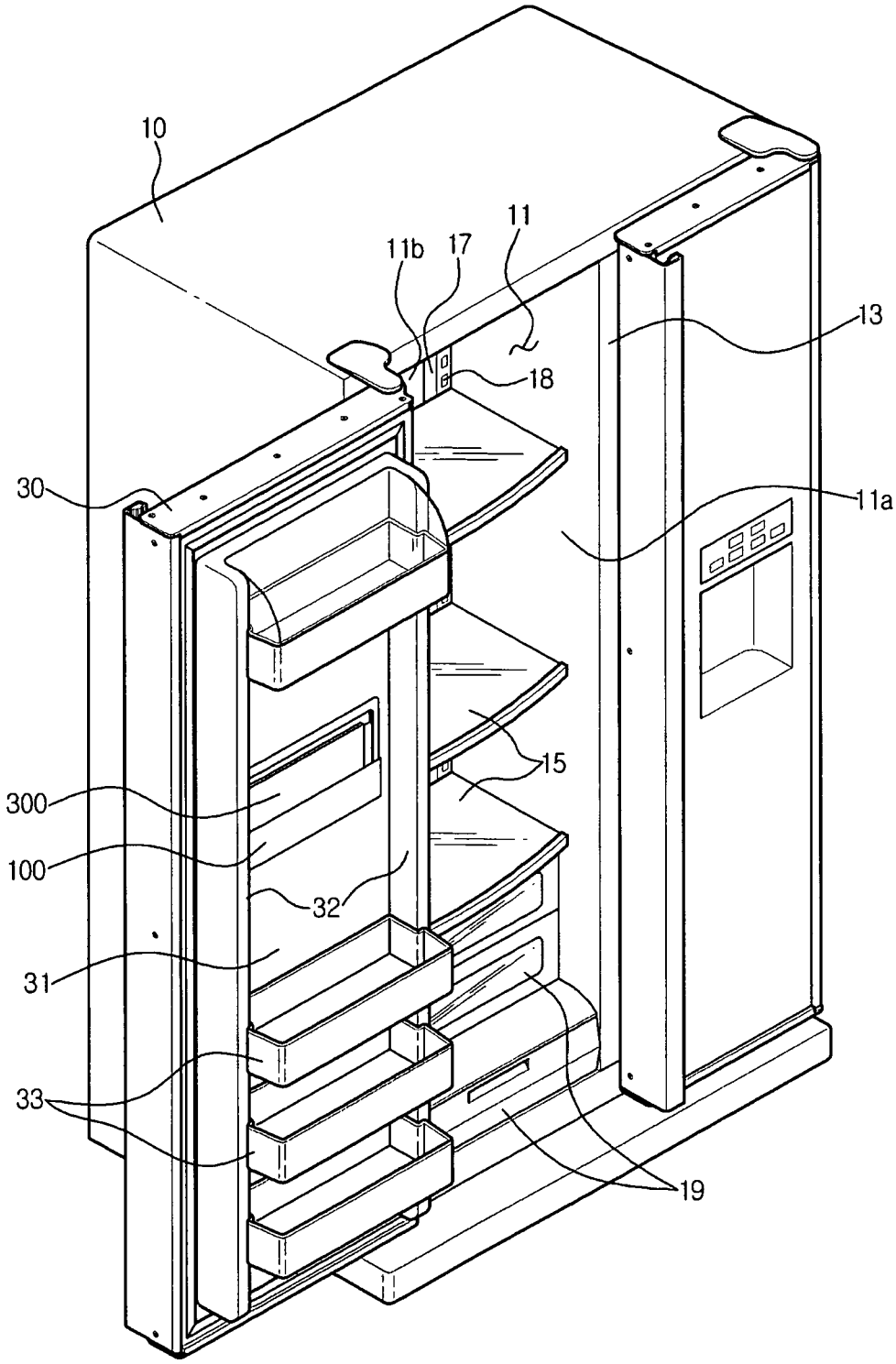
FIG. 1 is a perspective view showing a refrigerator according to an embodiment of the present invention.

Reference will now be made in detail to the embodiments of the present invention, examples of which are illustrated in the accompanying drawings, wherein like reference numerals refer to the like elements. The embodiments are described below to explain the present invention by referring to the figures.

Referring to FIG. 1, a refrigerator according to an embodiment of the present invention includes a refrigerator body 10 having a storage compartment 11 therein. A front part of the refrigerator body 10 is open. The storage compartment 11 formed in the refrigerator body 10 is divided into a freezing compartment and a refrigerating compartment by an intermediate wall 13.

In addition, a storage compartment door 30 is installed at the front part of the refrigerator body 10 to open/close the storage compartment 11. Thus, as the storage compartment door 30 closes the open front part of the refrigerator body 10, a storage space is defined in the storage compartment 11 of the refrigerator body 10 by left and right sidewalls 11*a* and a rear wall 11*b* of the storage compartment 11, and an inner wall 31 of the storage compartment door 30.

Although FIG. 1 shows that the storage compartment 11 of the refrigerator body 10 is divided into the freezing compartment and the refrigerating compartment, it is also possible to use the storage compartment 11 as the freezing compartment or the refrigerating compartment without dividing the storage compartment 11 using the intermediate wall 13.

At least one shelf 15 is provided in the storage compartment 11 to place foodstuffs thereon, and drawer type containers 19 are provided at a lower portion of the storage compartment 11 to store vegetables or fruits. The at least one shelf 15 may be secured within the storage compartment 11 by fitting the shelf 15 into rear wall brackets 17, the rear wall brackets each including a plurality of mounting recesses 18.

A pair of liners 32 are longitudinally installed at both sides of the inner wall 31 of the storage compartment door 30 such that a plurality of door guards 33 can be installed between the liners 32 to store foodstuffs.

A support member 100 is rotatably installed between the liners 32. A cold storage unit 300 is accommodated in the support member 100 to prevent the internal temperature of the storage compartment 11 from excessively rising upon an electricity failure.

Figure 2:
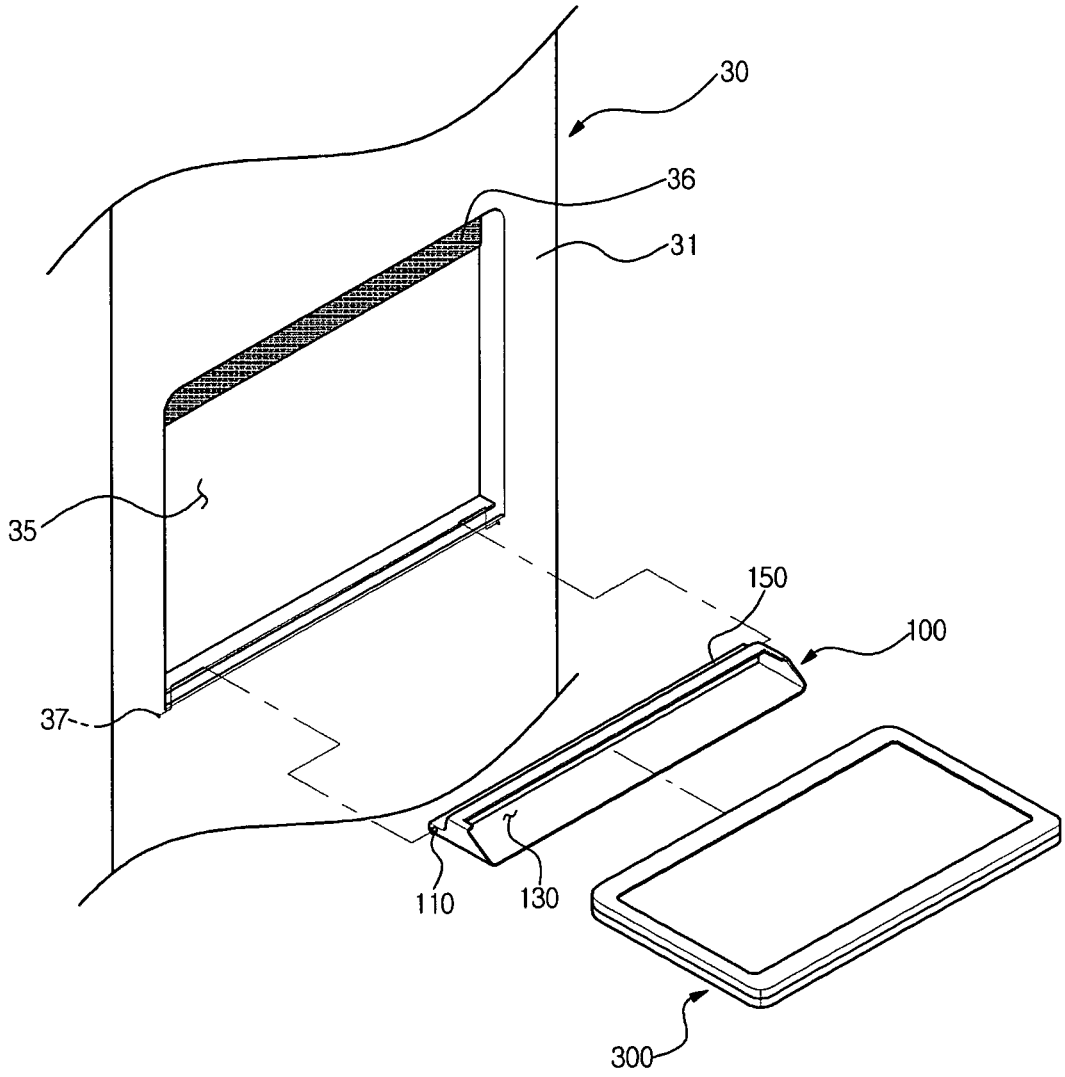
FIG. 2 is a perspective view showing a cold storage unit installed at a door of a storage compartment according to an embodiment of the present invention.

As shown in FIG. 2, the support member 100 is provided at a rear end portion thereof with a supporter 150 that is supported on the inner wall 31 of the storage compartment door 30 when the support member 100 is rotated. Hinge shafts 110 are provided at both lateral sides of the supporter 150 and an insertion groove 130 is formed at a front portion of the supporter 150 to receive the cold storage unit 300.

A recess 35 is formed in the inner wall 31 of the storage compartment door 30 at a region between the liners 32 (FIG. 1) where the support member 100 is installed. The recess 35 has a shape corresponding to a shape of the cold storage unit 300 to reduce waste of the storage space.

A magnet 36 is attached to the upper portion of the recess 35 in the transverse direction, and hinge holes 37 are formed at both lower sides of the recess 35 such that the hinge shafts 110 of the support member 100 can be inserted into the hinge holes 37.

Figure 6:
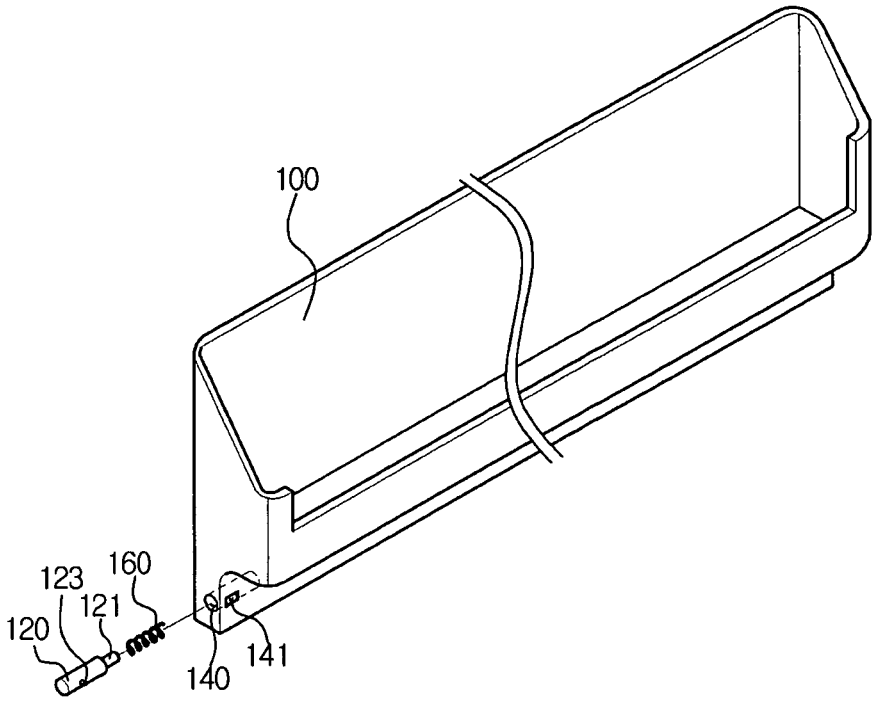
FIG. 6 is a perspective view showing a hinge shaft of a support member according to an embodiment of the present invention.
Figure 7:
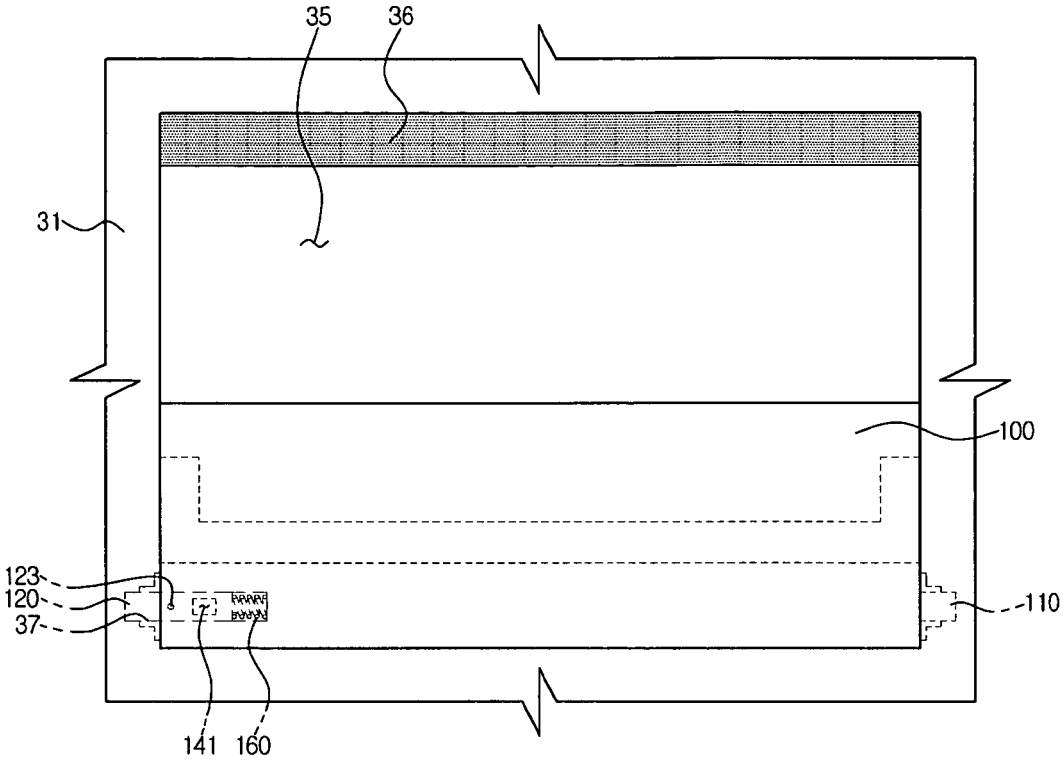
FIG. 7 is a view showing the coupling state of a support member according to an embodiment of the present invention.

FIG. 6 is a perspective view showing a hinge shaft of a support member according to an embodiment of the present invention, and FIG. 7 is a view showing the coupling state of the support member according to an embodiment of the present invention. The same reference numerals will be used to refer to the same elements and detailed description thereof will be omitted in order to avoid redundancy.

Referring to FIGS. 6 and 7, a hinge shaft 120 according to an embodiment of the present invention is rotatably inserted into a hinge hole 37 of a recess 35. In this case, the hinge shaft 120 is configured to be easily inserted into the hinge hole 37 by simply pushing the hinge shaft 120.

To this end, a hinge receptacle 140 is formed at one side of the support member 100 to receive the hinge shaft 120. The hinge receptacle 140 has a depth sufficient for completely receiving the hinge shaft 120. An inner diameter of the hinge receptacle 140 is slightly larger than an outer diameter of the hinge shaft 120 such that the hinge shaft 120 can slide in the hinge receptacle 140.

An elastic member 160 is provided in the hinge receptacle 140. The elastic member 160 applies elastic force to the hinge shaft 120 such that one end of the hinge shaft 120 can be inserted into the hinge hole 37 when the support member 100 is accommodated in the recess 35.

The elastic member 160 includes a coil compression spring and both ends of the elastic member 160 are supported on an elastic member supporter 121 of the hinge shaft and an inner end portion of the hinge receptacle 140, respectively.

The hinge shaft 120 is fixedly maintained when the hinge shaft 120 has been inserted into the hinge receptacle 140. To this end, an elastic protrusion 123 is provided in the hinge shaft 120 and a locking hole 141 is formed in the hinge receptacle 140 to receive the elastic protrusion 123.

That is, if a user presses the hinge shaft 120 with predetermined pressure, the hinge shaft 120 is moved into the hinge receptacle 140 while compressing the elastic member 160. At this time, the protrusion 123 formed in the hinge shaft 120 is locked with the locking hole 141, so that hinge shaft 120 is fixed in the hinge receptacle 140.

In this state, after accommodating the support member 100 in the recess 35, if the user presses the protrusion 123, the protrusion 123 is separated from the locking hole 141, so that the hinge shaft 120 is inserted into the hinge hole 37 due to elastic force of the elastic member 160.

Thus, the support member 100 can be simply coupled with the recess 35, so that productivity and workability can be improved.

According to an embodiment of the present invention, the hinge shaft 120 is slidably moved at one side of the support member 100. However, embodiments of the present invention are not limited thereto. According to an embodiment of the present invention, the hinge shaft 120 can be provided at both sides of the support member 100.

Figure 3:
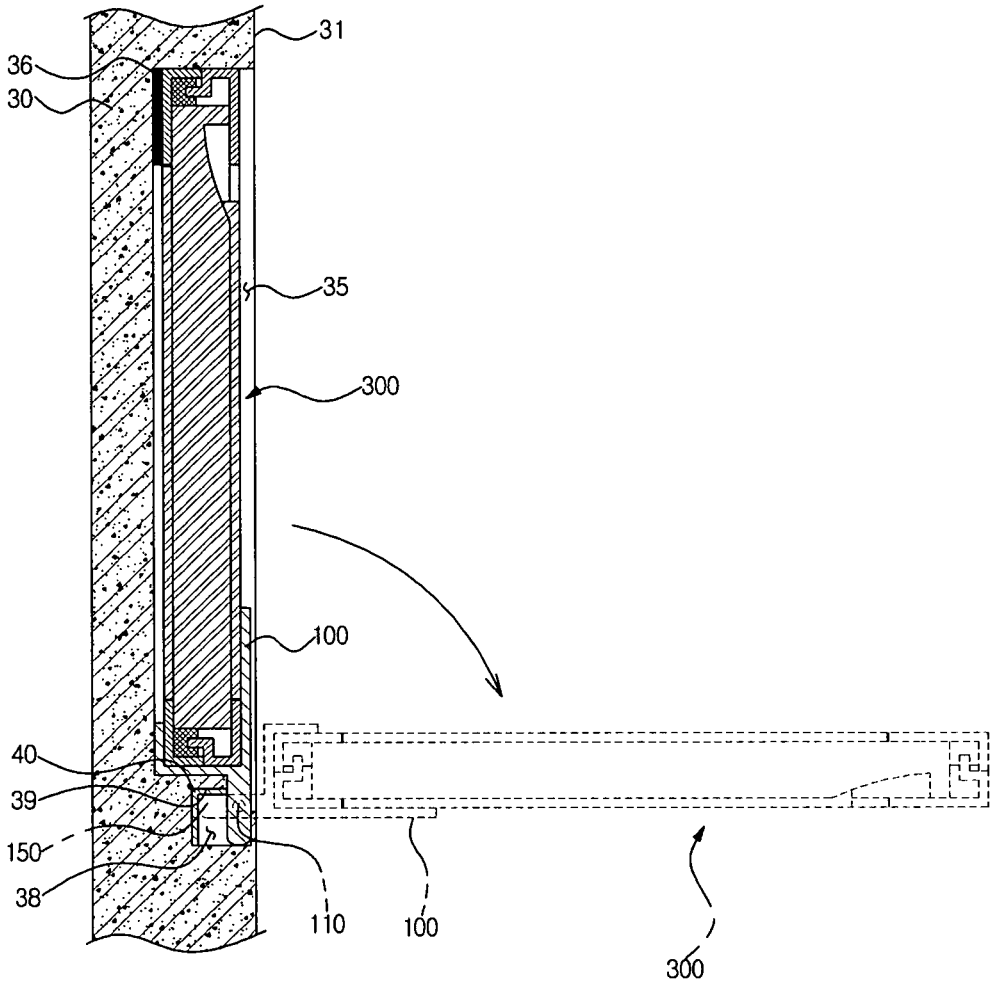
FIG. 3 is a sectional view showing the operational state of a cold storage unit according to an embodiment of the present invention.

As shown in FIG. 3, an insertion hole 38 is formed at a lower portion of the recess 35 to receive the supporter 150 of the support member 100.

A stopper 39 is provided at an upper portion of the insertion hole 38. The stopper 39 supports the supporter 150 to limit the rotational radius of the support member 100.

A reinforcement member 40 is installed in the stopper 39 to reinforce strength of the stopper 39 when the supporter 150 is supported on the stopper 39.

Therefore, when the support member 100 is rotatably moved in the forward direction about the hinge shaft 110 in a state in which the support member 100 is accommodated in the recess 35 formed at the inner wall 31 of the storage compartment door 30, the rotation of the supporter 150 of the support member 100 is limited by the stopper 39, so that the rotation of the support member 100 may be limited within an angle of about 90 degrees.

In addition, since the support member 100 may not protrude from the inner wall 31 of the storage compartment door 30 when the support member 100 is accommodated in the recess 35, the aesthetic appearance and efficiency of the storage space can be improved.

According to an embodiment of the present invention, the support member 100 is accommodated in the recess 35 formed in the inner wall 31 of the storage compartment door 30 such that the support member 100 may not protrude from the inner wall 31 of the storage compartment door 30. However, according to an embodiment of the present invention, the hinge hole can be formed in the liners 32 (FIG. 1) provided at the inner wall 31 of the storage compartment door 30 without forming the recess 35 in such a manner that the hinge shaft 110 of the support member 100 can be rotatably coupled to the hinge hole formed in the liners 32 (FIG. 1).

In addition, according to an embodiment of the present invention, the recess 35 serving as a space for receiving the support member 100 is provided in the inner wall 31 of the storage compartment door 30. However, according to an embodiment of the present invention, the recess 35 can be formed at the sidewall 11*a* (FIG. 1) or the rear wall 11*b* (FIG. 1) of the storage compartment 11 (FIG. 1).

The cold storage unit 300 is detachably provided in the insertion groove 130 (FIG. 2) of the support member 100 rotatably installed in the recess 35. As shown in FIG. 3, the cold storage unit 300 is accommodated in the support member 100 and serves as a shelf for foodstuffs together with the support member 100 when the support member 100 accommodated in the recess 35 of the storage compartment door 30 is rotated in the forward direction by an angle of 90 degrees.

In addition, since the cold storage unit 300 is detachably coupled with the insertion groove 130 (FIG. 2) of the support member 100, the user can use the cold storage unit 300 as a dish or a support plate for foodstuffs in the fields by separating the cold storage unit 300 from the support member 100.

Figure 4:
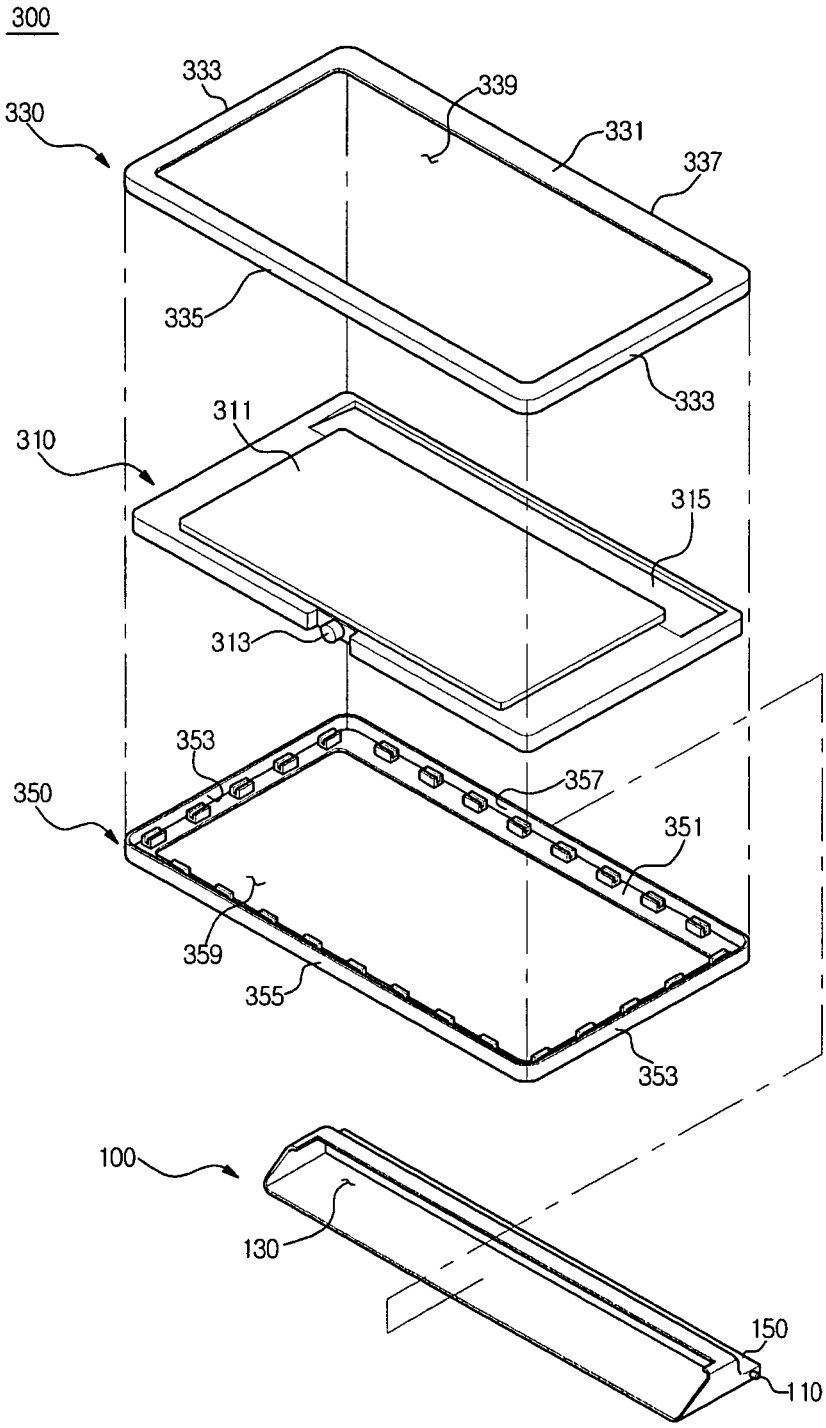
FIG. 4 is an exploded perspective view of a cold storage unit according to an embodiment of the present invention.

That is, the cold storage unit 300 may serve as the shelf for the foodstuffs in the storage compartment 11 (FIG. 1) and serve as the dish or the support plate for foodstuffs in the fields. As shown in FIG. 4, the cold storage unit 300 includes a cold storage pack 310 filled with cold storage material that is liquid-phase material capable of performing phase change, an upper frame 330 coupled with the top surface of the cold storage pack 310, and a lower frame 350 coupled with the bottom surface of the cold storage pack 310.

The cold storage material is liquid-phase material capable of performing phase change and includes chemical material containing alcohol, sodium chloride aqueous solution, polyethylene glycol or polyvinyl alcohol, or a mixture obtained by mixing the chemical material with water and alcohol. In addition, the cold storage material may include metal or solid-phase material having high specific heat and heat conductivity.

The cold storage pack 310 has a substantially rectangular shape and protrusion plates 311 and 312 (see, FIG. 5) are provided at the top and bottom surfaces of the cold storage pack 310 such that a storage space having a predetermined volume can be formed in the cold storage pack 310 to store the cold storage material. An injection port 313 is formed at the front surface of the cold storage pack 310 such that the cold storage material can be injected into the storage space defined by the protrusion plates 311 and 312.

Figure 5:
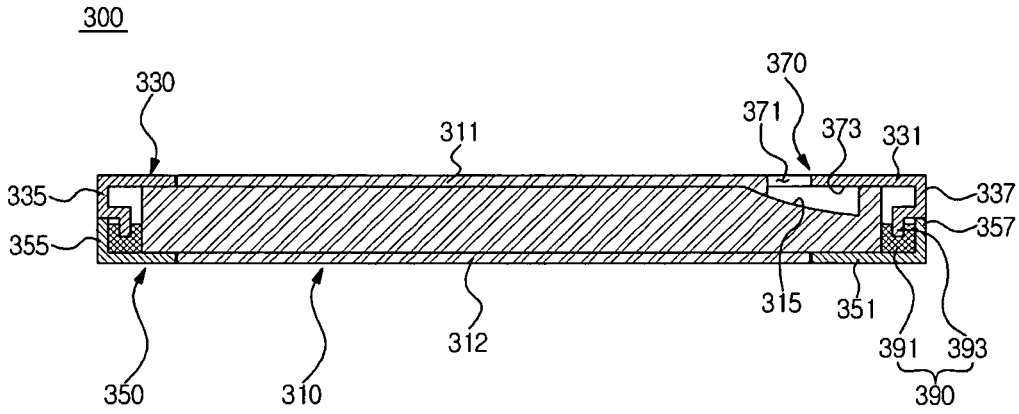
FIG. 5 is a sectional view showing the coupling state of a cold storage unit according to an embodiment of the present invention.

In addition, a handle groove 315 having a predetermined depth is formed at one side of the top surface of the cold storage pack 310. As shown in FIG. 5, the handle groove 315 is formed below a finger inlet section 371 and is gradually inclined downward in the right direction from the finger inlet section 371 such that the user can easily grip the cold storage pack 310.

The lower frame 350 includes a lower surface section 351 for supporting a lower edge portion of the cold storage pack 310, lateral sections 353 (FIG. 4) protruding upward from both side ends of the lower surface section 351, a front surface section 355 protruding upward from a front end of the lower surface section 351, and a rear surface section 357 protruding upward from a rear end of the lower surface section 351. The lower surface section 351 has a hollow section 359 (FIG. 4) having a shape corresponding to a shape of the protrusion plate 312 of the cold storage pack 310 such that the protrusion plate 312 provided at the bottom surface of the cold storage pack 310 can be received in the hollow section 359 (FIG. 4) when the lower frame 350 supports the cold storage pack 310. Thus, as shown in FIG. 5, the bottom surface of the cold storage pack 310 is planarized when the cold storage pack 310 is combined with the lower frame 350, so that foodstuffs can be placed on the cold storage pack 310.

Referring again to FIG. 4, the upper frame 330 includes an upper surface section 331 for supporting an upper edge portion of the cold storage pack 310, lateral sections 333 protruding downward from both side ends of the upper surface section 331, a front surface section 335 protruding downward from a front end of the upper surface section 331, and a rear surface section 337 protruding downward from a rear end of the lower surface section 331. In addition, a hollow section 339 is formed in the upper surface section 331 to receive the protrusion plate 311 provided on the top surface of the cold storage pack 310.

The size of the hollow section 339 formed in the upper frame 330 is slightly larger than the size of the protrusion plate 311 provided on the top surface of the cold storage pack 310 in order to form the finger inlet section 371 when the upper frame 330 is coupled with the top surface of the cold storage pack 310 as shown in FIG. 5.

That is, when the upper frame 330 is coupled with the top surface of the cold storage pack 310, the upper surface section 331 (FIG. 4), which is adjacent to the rear surface section 337 of the upper frame 330, partially covers an upper portion of the handle groove 315, so that a handle section 370 having the finger inlet section 371 and a gripping section 373, which allows the user to easily grip the cold storage unit 300, can be formed in the cold storage unit 300.

The upper and lower frames 330 and 350 are made from metallic material such that the cold storage unit 300 is attracted to the magnet 36 provided at the upper portion of the recess 35 (FIG. 3) in a state in which the cold storage unit 300 is accommodated in the recess 35 (FIG. 3). In addition, another magnet having polarity different from that of the magnet 36 (FIG. 3), provided in the recess 35 (FIG. 3), can be attached to the cold storage unit 300 after forming the upper and lower frames 330 and 350 through an injection molding process using plastic material.

In addition, as shown in FIG. 5, when the upper and lower frames 330 and 350 are coupled with the top and bottom surfaces of the cold storage unit 300, respectively, the upper frame 330 is closely secured to the lower frame 350 by an elastic coupling member 390. To this end, the elastic coupling member 390 includes a plurality of elastic coupling grooves 391 formed on the lower surface section 351 of the lower frame 350 for coupling the upper frame 330, and a plurality of coupling protrusions 393 provided at the front surface section 335, the lateral sections 335, and the rear surface section 337 of the upper frame 330. The coupling protrusions 393 extend toward the lower frame 350 so as to be coupled with the elastic coupling grooves 391.

That is, when the coupling protrusions 393 are being inserted into the elastic coupling grooves 391, the elastic coupling grooves 391 are elastically deformed outward. Then, when the coupling protrusions 393 have been inserted into the elastic coupling grooves 391, the elastic coupling grooves 391 securely clamp the coupling protrusions 393 due to elastic restoring force so that the upper frame 330 can be securely coupled with the lower frame 350. Thus, the upper frame 330 can be easily coupled with the lower frame 350 by simply pushing the upper frame 330 toward the lower frame 350.

According to an embodiment of the present invention, the elastic coupling section 390 includes the elastic coupling grooves 391 and the coupling protrusions 393 inserted into the elastic coupling grooves 391. However, according to an embodiment of the present invention, an elastic coupling, such as a hook coupling, can be adopted in order to facilitate the assembling and disassembling work for the upper and lower frames 330 and 350.

In addition, referring to FIG. 2, according to an embodiment of the present invention, the support member 100, which is used for accommodating the cold storage unit 300 in the recess 35 formed in the inner wall 31 of the storage compartment door 30, can be omitted. In this case, the hinge shafts 110 are provided at both lower sides of the cold storage unit 300 to allow the cold storage unit 300 to rotate about the hinge shafts 110.

Hereinafter, the usage method and effect of the cold storage unit according to an embodiment of the present invention will be described.

Referring again to FIG. 2, when the refrigerator is normally operated, since the cold storage unit 300 provided at one sidewall defining the storage space, preferably, accommodated in the recess 35 formed at the inner wall 31 of the storage compartment door 30 is filled with the cold storage material, the cold storage unit 300 is accumulated with cold air in the storage space.

In addition, since the cold storage unit 300 is accommodated in the recess 35, which is formed at one sidewall defining the storage space, without protruding to the outside, the aesthetic appearance of the storage compartment can be improved. Further, since an extra space is not necessary to install the cold storage unit 300 in the storage compartment 11 (FIG. 1) of the refrigerator, the interior space of the storage compartment 11 (FIG. 1) may not be reduced so that space utility can be improved.

That is, according to an embodiment of the present invention, the door guards 33 (FIG. 1) can be installed in front of the cold storage unit 300 even if the cold storage unit 300 has been accommodated in the recess 35 of the storage compartment door 30.

In addition, if the user rotates the cold storage unit 300, which is provided at the inner wall 31 of the storage compartment door 30, in the forward direction by an angle of 90 degrees, the flat surface of the cold storage unit 300 is positioned on the top surface of the cold storage unit 300, so that the user can use the cold storage unit 300 as a support plate for foodstuffs.

Accordingly, when the user takes out various types of foodstuffs from the shelf 15 (FIG. 1) or the drawer type containers 19 (FIG. 1), the user can place the foodstuffs on the cold storage unit 300 so that the convenience of the user can be improved.

In addition, when the cold storage unit 300 according to an embodiment of the present invention is used in the field, the user can easily separate the cold storage unit 300 by simply pulling the cold storage unit 300 out of the insertion groove 130 of the support member 100 or the recess 35 formed in the inner wall 31 of the storage compartment door 30, so that the number of steps for separating the cold storage unit 300 can be reduced.

Referring to FIG. 5, further, the cold storage unit 300 according to an embodiment of the present invention is provided with the handle section 370, so that the user can easily carry the cold storage unit 300 by using the handle section 370 after separating the cold storage unit 300 from the refrigerator. That is, the user can carry the cold storage unit 300 without holding a cold part of the cold storage pack 310 filled with the cold storage material due to the handle section 370.

In addition, one side of the cold storage unit 300, that is, the protrusion plate 312 provided at the bottom surface of the cold storage pack 310 is planarized, so that the cold storage unit 300 can be used as a dish for foodstuffs in the field. In addition, when the user eats foodstuffs in the predetermined place, if the user places some foodstuffs, which easily go bad under the high temperature, on the protrusion plate 312 provided on the bottom surface of the cold storage pack 310 filled with the cold storage material, the foodstuffs can be kept in a fresh state for a predetermined period of time.

Further, according to the cold storage unit 300 of an embodiment of the present invention, an edge portion of the cold storage pack 310 filled with the cold storage material is covered with the upper and lower frames 330 and 350, so that the cold storage pack 310 can be safely maintained against external impact. In addition, the upper frame 330 can be easily coupled with the lower frame 350 by simply pushing the upper frame 330 toward the lower frame 350 due to the elastic coupling section 390, so that the assembling and disassembling work for the upper and lower frames 330 and 350 can be facilitated. Further, when the cold storage unit 300 is dropped onto the ground by mistake, the upper and lower frames 330 and 350 are easily separated from each other due to the elastic coupling section 390, so that impact transferred to the cold storage pack 310 can be reduced, thereby preventing the cold storage pack 310 from being broken.

Although few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A refrigerator comprising:

a storage compartment;

a door for opening/closing a front surface of the storage compartment;

a cold storage unit provided in a storage space defined in the storage compartment, the cold storage unit including:

a cold storage pack provided at one side thereof with a handle groove section;

an upper frame coupled with a top surface of the cold storage pack; and a lower frame coupled with a bottom surface of the cold storage pack, wherein at least one of the upper and lower frames forms a handle section in cooperation with the cold storage pack, and wherein the cold storage pack is located between the upper frame and the lower frame and the cold storage pack is filled with cold storage material to prevent an internal temperature of the storage compartment from excessively rising upon an electricity failure;

a support member rotatable coupled to the door by a hinge, the support member being formed with an insertion groove to receive the cold storage unit, wherein the cold storage unit is removably accommodated in the support member and the cold storage unit serves as a shelf when the cold storage unit rotates into the storage space defined in the storage compartment, wherein the cold storage unit and the support member are received in a recess formed in the door, the cold storage unit being detachably coupled to the support member while having a portion of the cold storage unit accommodated in the insertion groove of the support member.

2. The refrigerator as claimed in claim 1, wherein a stopper is provided at the sidewall where the cold storage unit is rotatably installed to limit rotation of the cold storage unit when the cold storage unit is perpendicular to the sidewall.

3. The refrigerator as claimed in claim 2, wherein a reinforcement member including metallic material is provided in the stopper.

4. The refrigerator as claimed in claim 1, wherein a recess is formed at the sidewall where the cold storage unit is provided to receive the cold storage unit therein.

5. The refrigerator as claimed in claim 4, wherein a magnet is provided in at least one of the recess and the cold storage unit.

6. The refrigerator as claimed in claim 4, wherein the support member is rotatably coupled to a lower portion of the recess by a hinge.

7. The refrigerator as claimed in claim 1, wherein the upper and lower frames include an elastic coupling section that is elastically deformed to maintain a coupling state between the upper and lower frame.

8. The refrigerator as claimed in claim 1, wherein the cold storage unit is detachable from the inner sidewall defining the storage space when the cold storage unit rotates.

9. A refrigerator comprising:

a storage compartment;

a storage compartment door for opening/closing a front surface of the storage compartment;

a storage space defined by the storage compartment and the storage compartment door;

a cold storage unit including:

a cold storage pack provided at one side thereof with a handle groove section;

an upper frame coupled with a top surface of the cold storage pack; and a lower frame coupled with a bottom surface of the cold storage pack, and wherein at least one of the upper and lower frames forms a handle section in cooperation with the cold storage pack, and wherein the cold storage pack is located between the upper frame and the lower frame and the cold storage pack is filled with cold storage material to prevent an internal temperature of the storage compartment from excessively rising upon an electricity failure;

a recess formed at an inner sidewall defining the storage space to receive the cold storage unit therein; and a support member rotatably coupled to a lower portion of the recess by at least one hinge such that the cold storage unit is removably accommodated in the support member and such that the cold storage unit is configured to rotate into the storage space defined in the storage compartment, the support member being formed with an insertion groove to receive the cold storage unit, wherein the cold storage unit and the support member are received in the recess, the cold storage unit being detachably coupled to the support member while having a portion of the cold storage unit accommodated in the insertion groove of the support member.

10. The refrigerator as claimed in claim 9, wherein the handle groove section is formed with a predetermined depth, and the upper and lower frames are formed with upper and lower edge portions of the cold storage pack, respectively, to cover an edge portion of the cold storage unit.

11. The refrigerator as claimed in claim 9, wherein the support member includes hinge shafts provided at both sides of the support member, and a supporter supported by a stopper provided in the storage compartment door to limit a rotational radius of the support member.

12. The refrigerator as claimed in claim 11, wherein the support member is formed with a hinge receptacle to receive at least one of the hinge shafts and the at least one hinge is slidably moved in the hinge receptacle.

13. A cold storage unit for a refrigerator comprising:

a pack with a thermal mass capable of preventing an internal temperature of a storage compartment in the refrigerator from excessively rising;

a support member including an insertion groove to receive the pack; and a recess, formed in an inner side of a refrigerator door, which the pack and support member fit flush within such that the pack is configured to rotate into the storage space defined in the storage compartment;

an upper surface section for supporting an upper edge portion of the pack;

lateral sections protruding downward from both side ends of the upper surface section;

a front surface section protruding downward from a front end of the upper surface section;

a rear surface section protruding downward from a rear end of the upper surface section; and a lower frame comprising a lower surface section having a hollow section with a shape corresponding to a shape of a protrusion plate of the pack such that the protrusion plate, provided at the bottom surface of the pack, can be received in the hollow section when the lower frame supports the pack, wherein the cold storage pack is located between the upper frame and the lower frame and the cold storage pack is filled with cold storage material to prevent an internal temperature of the storage compartment from excessively rising upon an electricity failure, and wherein the cold storage unit and the support member are received in the recess, the cold storage unit being detachably coupled to the support member while having a portion of the cold storage unit accommodated in an insertion groove of the support member.

14. The cold storage unit as claimed in claim 13 wherein the support member is rotatably installed at a lower end of the recess.

15. The cold storage unit as claimed in claim 13 wherein the pack includes a handle groove.

16. The cold storage unit as claimed in claim 13 wherein the upper frame is closely secured to the lower frame by an elastic coupling member.

* * * * *